US011103739B2

(12) United States Patent
Shaw, Jr.

(10) Patent No.: US 11,103,739 B2
(45) Date of Patent: Aug. 31, 2021

(54) DEVICE TO POSITION DUMBBELLS FOR EXERCISE

(71) Applicant: Vincent Gabriel Shaw, Jr., Davidsonville, MD (US)

(72) Inventor: Vincent Gabriel Shaw, Jr., Davidsonville, MD (US)

( * ) Notice: Subject to any disclaimer, the term of this patent is extended or adjusted under 35 U.S.C. 154(b) by 155 days.

(21) Appl. No.: 16/403,604

(22) Filed: May 5, 2019

(65) Prior Publication Data

US 2020/0346063 A1 Nov. 5, 2020

(51) Int. Cl.
*A63B 21/078* (2006.01)
*A63B 21/072* (2006.01)

(52) U.S. Cl.
CPC ..... *A63B 21/078* (2013.01); *A63B 21/0726* (2013.01); *A63B 2225/093* (2013.01)

(58) Field of Classification Search
CPC ..... A63B 21/078; A63B 21/0783; A63B 21/0726
See application file for complete search history.

(56) References Cited

U.S. PATENT DOCUMENTS

D425,152 S * 5/2000 Ceppo ..... D21/662
6,149,556 A * 11/2000 Jordan ..... A63B 71/0036 482/104
6,709,370 B1 * 3/2004 Evans ..... A63B 21/078 482/104
7,001,314 B1 * 2/2006 Hummer, Jr. .... A63B 21/00181 482/104
D578,173 S * 10/2008 James ..... D21/686
7,678,030 B2 * 3/2010 Savage ..... A63B 71/0036 482/104
9,717,943 B2 * 8/2017 Klonoski ..... A63B 21/078
2005/0009671 A1 * 1/2005 Hummer, Jr. ..... A63B 21/078 482/94
2007/0049472 A1 * 3/2007 Hummer, Jr. ..... A63B 71/0036 482/104
2007/0099773 A1 * 5/2007 Hummer, Jr. ..... A63B 21/078 482/104

(Continued)

*Primary Examiner* — Joshua T Kennedy

(57) ABSTRACT

An apparatus to hold and position dumbbells with adjustment through three dimensions (vertical, horizontal and forward and backward) so as to provide an elevated and precisely positioned starting and ending position for the dumbbells used in a dumbbell exercise. The apparatus may be configured as a stand-alone device, an attachment to another piece of equipment (such as a power rack or bench press) or integrated into another piece of exercise equipment such as a lying/incline/seated press apparatus. It enables adjustment of the dumbbell position by the user while the user is positioned for the exercise, as well as prior to assuming the positon for the exercise, to provide precise positioning as desired by each individual user. It features a channeling device which guides a user's hands, wrists and arms when returning the dumbbell to the holder.

Additionally, a support apparatus to hold and position dumbbells for exercise featuring a channel structure which a user's hand, wrist or arm may contact to guide the return of the dumbbell to the support structure, and expanded surface areas on points of the apparatus which a user's body parts may contact which reduce the potential for concentrated contact between a user and the apparatus.

1 Claim, 7 Drawing Sheets

(56) References Cited

U.S. PATENT DOCUMENTS

| | | | | |
|---|---|---|---|---|
| 2009/0286658 | A1* | 11/2009 | James | A63B 21/4029<br>482/104 |
| 2012/0157271 | A1* | 6/2012 | Bauer | A63B 71/0036<br>482/104 |
| 2018/0178051 | A1* | 6/2018 | Shaw, Jr. | A63B 21/4029 |

* cited by examiner

DEVICE TO POSITION DUMBBELLS FOR EXERCISE

FIELD OF THE INVENTION

The invention relates to the field of exercise equipment. Specifically it provides a device for the flexible positioning of dumbbells for the start and completion of an exercise, similar in concept to racks used to position barbells for exercise.

DESCRIPTION OF RELATED ART

Several applications and patents in the prior art show devices which attempt to allow dumbbells to be positioned for the start and finish of an exercise set however nowhere in the prior art is there a dumbbell holding device intended for supporting exercise positioning which includes a self-centering hand/arm guide with expanded contact areas built into the user-facing portion of the center channel of the dumbbell holder to guide a user's return of the dumbbell to the dumbbell holder. Examples of the many differences between the prior art and the present invention include that the prior inventions:

- Do not allow for precise movement of the device to position the dumbbell while the user is in a position to perform an exercise, unlike the present invention which allows the user to precisely position the dumbbells using both the horizontal and swivel functions, and the option to roll the dumbbells forward and back on the dumbbell holder.
- Do not allow for any adjustment to horizontal positioning except by moving the entire apparatus, unlike the present invention
- Do not allow for the apparatus or a subset of the apparatus to be attached to other devices commonly found in a gym such as a power rack or to be integrated into a specific piece of equipment such as a bench press apparatus, unlike the present invention.
- Do not have an inner "lip" on the dumbbell holder portion of the apparatus to prevent side-to-side slippage of the dumbbell
- Do not have a self-centering hand/arm guide to aid in return the dumbbell to the holder
- Do not allow for the dumbbell holder to be optionally moved further from the field of exercise motion during the exercise after the dumbbell has been removed from the holder for use in the exercise, either via mechanical or manual methods.

U.S. Pat. No. 7,534,198 B1 provides for a degree of positioning and retraction while I the exercise position, but through an entirely different mechanism (casters on the base) than the present invention. It also does not allow for ease of use without the retraction feature or integration into other equipment as shown in the embodiments for the present invention.

U.S. Pat. No. 6,149,556 includes a dumbbell holder component with some similarities however the claimed items for the holder do not include an inner lip or a self-centering hand guide, and the rest of the invention is substantially different.

Other patents which attempt to address a sub-set of the intent of the present invention include numerous US Patents and Patent Applications.

Given the lack of practicality of any of the above art, none of them have been widely adopted and the current common method of positioning a dumbbell for exercise is overwhelmingly manual, with the dumbbell being lifted from the floor or from a storage rack and then moved into positon for the exercise solely by one or more users of the dumbbells. This is a manual, limiting, awkward and potentially dangerous process which the present invention seeks to substantially eliminate.

Additionally, there are numerous devices for positioning a barbell for the start of exercise, however none of these can be used to hold or adjust a dumbbell in a manner in which it can be removed, used for exercise and replaced while the user is in the exercise position. The present invention seeks to create and partially exceed for dumbbells the exercise positioning capability currently available for barbells, which has to this point not been available through prior art.

Another critical advance provided by the present invention is a channeling device using expanded contact areas and a gradual transition from the front of the support to the inner channel which guides the user's hands when returning the dumbbell to the holder: all the prior art subjects the user to an extreme risk of injury and/or discomfort due to the potential for contact between the user's hand, wrist or arm and points of potential concentrated contact on the front or inner channel of the dumbbell holder, and this deficiency alone makes the prior art commercially non-viable due to likely liability risk due to potential for injury to the user.

A key requirement for the successful development of a device such as the present invention is the ability to support a dumbbell in a position to be delivered to the user and to allow the user to safely return the dumbbell to the support device. Prior art includes numerous instances of attempts at such a device all of which will support dumbbells in a position to start an exercise with varying degrees of related functionality, and in some of the prior art, the ability for the user to return the dumbbell to the support device under ideal and non-stressful conditions.

In order for such a device to be commercially viable it is essential that risk of injury to the user be minimized. The primary source of injury risk with such a device is the act of returning the dumbbell to the support device. This is not a significant issue for existing, commonly found barbell support devices (e.g. bench press, shoulder press) because the user's hands can be assumed to be a reasonable distance from potential contact points on the support apparatus when returning the barbell to the rack (excepting the case of user negligence.)

In the case of dumbbells however, the user's hands and arms must come in close proximity to the supporting surfaces due to the compact nature of dumbbells. Furthermore, the user can be expected to often be in a case of extreme tiredness when returning the dumbbells to the rack thereby lessening the degree of precise control of the dumbbell. This combination of characteristics makes it essential to reduce the potential for concentrated contact with a portion of the dumbbell supports in order to reduce the risk of injury. The present invention includes a combination of angles and surfaces as described in the specifications and figures below to provide risk reductions features that are highly distinct from the prior art and provide aspects of risk reduction not attempted in the prior art.

Finally, there are numerous types of devices for storing dumbbells in a fitness facility, however none of them are intended or can practically be used to position the dumbbell for the beginning and end of an actual exercise set for most types of dumbbell exercise movements. An example of these storage-only types of devices is shown in U.S. Patent Des. 262,776.

BRIEF SUMMARY OF THE INVENTION

The present invention comprises a combination of features for inclusion in a device to be used to support dumbbells at the start and conclusion of an exercise "set". The device is comprised of 1) two surfaces which provide support for the dumbbells to create support in the vertical dimension and which contact the dumbbells on the weighted portion on either side of the dumbbell handle, 2) a surface or surfaces at the rear portion of the support surfaces which prevent rearward travel of the dumbbell beyond the support device (away from the user), 3) a raised "lip or edge at the front portion of the support surface (nearer the user) 4) A vertical surface extending downward from the front "lip" or edge of the support surfaces 5) a series of angles or curves formed into the inside edges of the support surfaces which creates an inward-converging "channel" that guides a user's hand/arm toward the center of the channel while reducing the potential for concentrated contact with any part of the surface, and 6) Generally vertical surfaces extending from the channel boundary to provide a contact surface for the user's arm/hand that will reduce the potential for concentrated contact contained in the prior art.

The present invention comprises a mechanism to position dumbbells for the start and completion of an exercise set so that the need to lift the dumbbells from the floor, storage rack or other location while in position to perform the exercise is eliminated. This allows dumbbells to be used for strength training in a way similar to how barbells are currently used. It is distinguished from prior art by features including, but not limited to 1) the inclusion of three dimensional positioning (as opposed to simply vertical positioning) 2) the design of the dumbbell holder which allows the dumbbells to be rolled forward or backwards by the user while in position for the exercise for even more precise positioning, 3) the option to attach the dumbbell holders to an existing piece of equipment such as the commonly found "power rack", 4) the option to attach a second holder which allows the dumbbell to be safely returned to the rack in a case where the user cannot, perhaps due to fatigue or preference, return the dumbbell to the top position on the rack, 5) the option to retract and restore the position of the dumbbell holder during the exercise by means such as a foot control or spring mechanism, 6) a channeling design which guides the user's hand when returning the dumbbell to the holder to reduce risk of injury and the effort required by the user to replace the dumbbell on the device, and 7) a dumbbell holder which allows the dumbbell to be held in position prior to the user assuming the position for the exercise while also allowing the user to move the dumbbell forward and backward on the holder and side-to side by moving the holder through a horizontal arc while in position for the exercise. Two of the dumbbell holders are required to allow the user to position a dumbbell for each hand, and they may either be configured as "stand alone" units which are positioned on either side of a standing, seated or lying user, incorporated as fixed components of a weightlifting apparatus such as a bench-press rack, incorporated as components of a custom integrated stand, or attached to a separate mounting source such as a wall or power rack.

REFERENCE NUMBER DESCRIPTIONS

Figure 1:
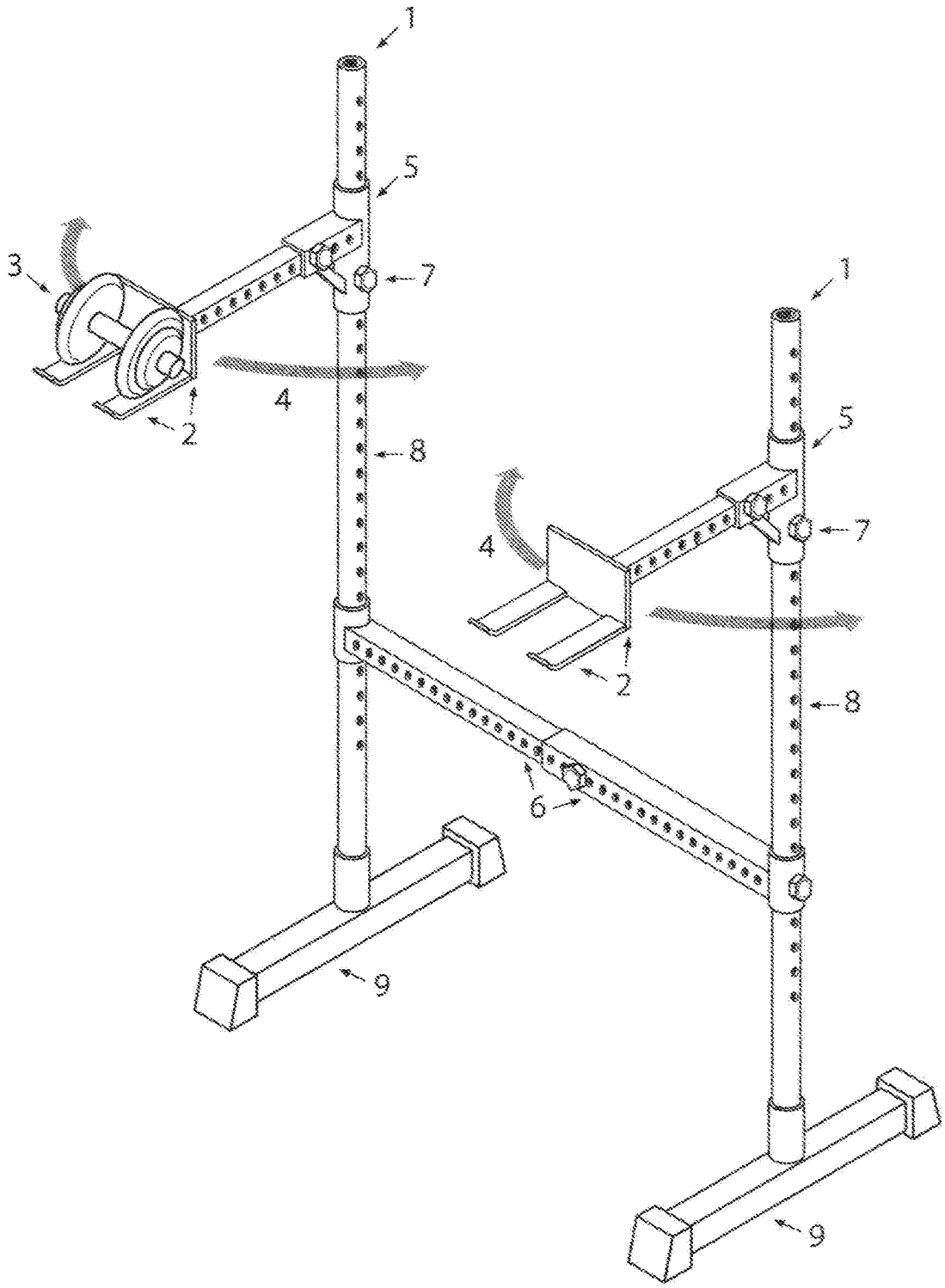
FIG. 1 shows an embodiment of the invention configured as a tree-standing integrated unit which can serve a user in either a standing position or when using a another piece of exercise equipment such as a flat bench positioned near the device.

1. Vertical adjustable support
2. Dumbbell Holder
3. Example Dumbbell
4. Horizontal Rotational Adjustment
5. Rotating and Forward/Backward Attachment
6. Width Adjustment Brace
7. Vertical Adjustment Pin
8. Vertical Adjustment Holes
9. Floor Stand
10. Example Power Rack Vertical Support
11. Attachment/Vertical Adjustment Pins
12. Swivel joint
13. Horizontal Rotation Plane
14. Support arm (optionally adjustable, as shown)
15. Dumbbell Holder
16. Horizontal dumbbell rest
17. Guide apparatus attachment plates
18. Hand Guides
19. Center Support
20. Upper swiveling support arm
21. Lower swiveling support arm
22. Base
23. Wheels
24. Upper Dumbbell holder
25. Lower dumbbell holder
26. Flat bench press
27. Dumbbell holders
28. Channel boundary
29. Support surface lip and front-edge boundary
30. Inner channel and inner support surface edge boundary

31. Support surface for dumbbell weights
32. Rear support surface boundary
33. Angled or curved channel boundary and contact surface
34. Support surface front boundary
35. Inner channel and inner support surface edge boundary surface
36. Support surface front boundary
37. Rear support surface boundary

DETAILED DESCRIPTION OF THE INVENTION

FIG. 1 shows the invention configured as a free-standing, integrated unit comprised of two supports for two dumbbells holders which would be positioned to deliver dumbbells to each hand of the user who would typically be in either a standing, seated, lying, or incline position to perform the exercise and may have positioned another piece of related equipment nearby such as an incline bench. For example, the user could be seated or lying on an adjacent support when the dumbbells are removed from the rack, or the user could remove them in a standing position, or sit in the type of seat made for seated dumbbell presses to perform the exercise, and then return to a standing position to return the dumbbells to the rack. Any of these would be far easier than lifting the dumbbells from the floor or using a fixed stand which does not allow for extensive tailoring and adjustment of the dumbbell position such as described by the prior art.

Prior to the exercise, the user would position the dumbbell holder (2) with the dumbbell in the position desired by the user to remove the dumbbell from the stand at the start of the exercise, and to return the dumbbell to when the exercise repetitions are completed. To accomplish this positioning, the invention would be positioned in a general location near the position of the exercise such that further adjustment to achieve the exact location desired by the user could be achieved by use of the invention's vertical and horizontal adjustments, both prior to assuming the position of the exercise, and, for the horizontal rotation shown in arc (4), while in the position of the exercise. Vertical positioning would occur by adjusting the Support Arm(s) (5) on the vertical support member (1) and could be done either prior to or after placing the dumbbell in the dumbbell holder, especially if a ratchet or similar mechanism was used to lift and lower the support arm. Horizontal positioning could occur by swiveling the support arm/dumbbell holder combination (2, 5) around the center support (within the range of support provided by the base). Several options exist for implementing he swivel function such as having the vertical supports rotate in the base (shown in this example) or having the support arms (5) swivel around the vertical supports (1). Further horizontal positioning of the dumbbell holder could occur by adjusting the length of the support arm (5) using an adjustment mechanism such as the telescoping arm with adjustment pin and pin-holes as shown in FIG. 1. Additional positioning of the dumbbell could occur by rolling the dumbbell forward or backward on the dumbbell holder supports (2).

The space between the two horizontal portions of the dumbbell holder (2) is wide enough to allow the hand of the user to pass between them when removing or replacing the dumbbells. Additionally, the user could easily position the dumbbells in a precise location by rotating the holder horizontally while in the position required by the exercise allowing precise tailoring of the dumbbell positions. The dumbbell holder supports have a front angle to secure the dumbbells from rolling off and to aid in the return of the dumbbells at the completion of the exercise, and would also have an inner "lip" as shown to provide additional side-to-side positioning stability. The rear plate on the dumbbell holder (2) braces the dumbbell at the rear in the direction away from the user. All user-facing surfaces which the user's hand or arm could contact when returning the dumbbell could optionally have padding to provide further protection against injury. These surfaces would include the front "lip" of the dumbbell holder (2) and the hand channel device (18).

The invention thus provides precise three-dimensional positioning of the dumbbells which can be tailored to the desired position for each hand of the user with final adjustment occurring while the user is in the positon of the exercise. Vertical positioning is accomplished by adjusting the holder arms on the vertical center stand. In the embodiment shown, pin adjustment (7) holes in the vertical support (8) is shown for the vertical adjustment, however other forms of adjustment could optionally be incorporated (e.g., a ratchet mechanism).

Wheels or another type of rolling device such as casters or rollers could be placed on one or both support stand bases (9) to facilitate moving the device and also to facilitate adjusting the width between the support and hence the positioning of the dumbbell support devices. The width between the vertical supports (1) could be adjusted by means of one or more telescoping braces (6).

Figure 2:
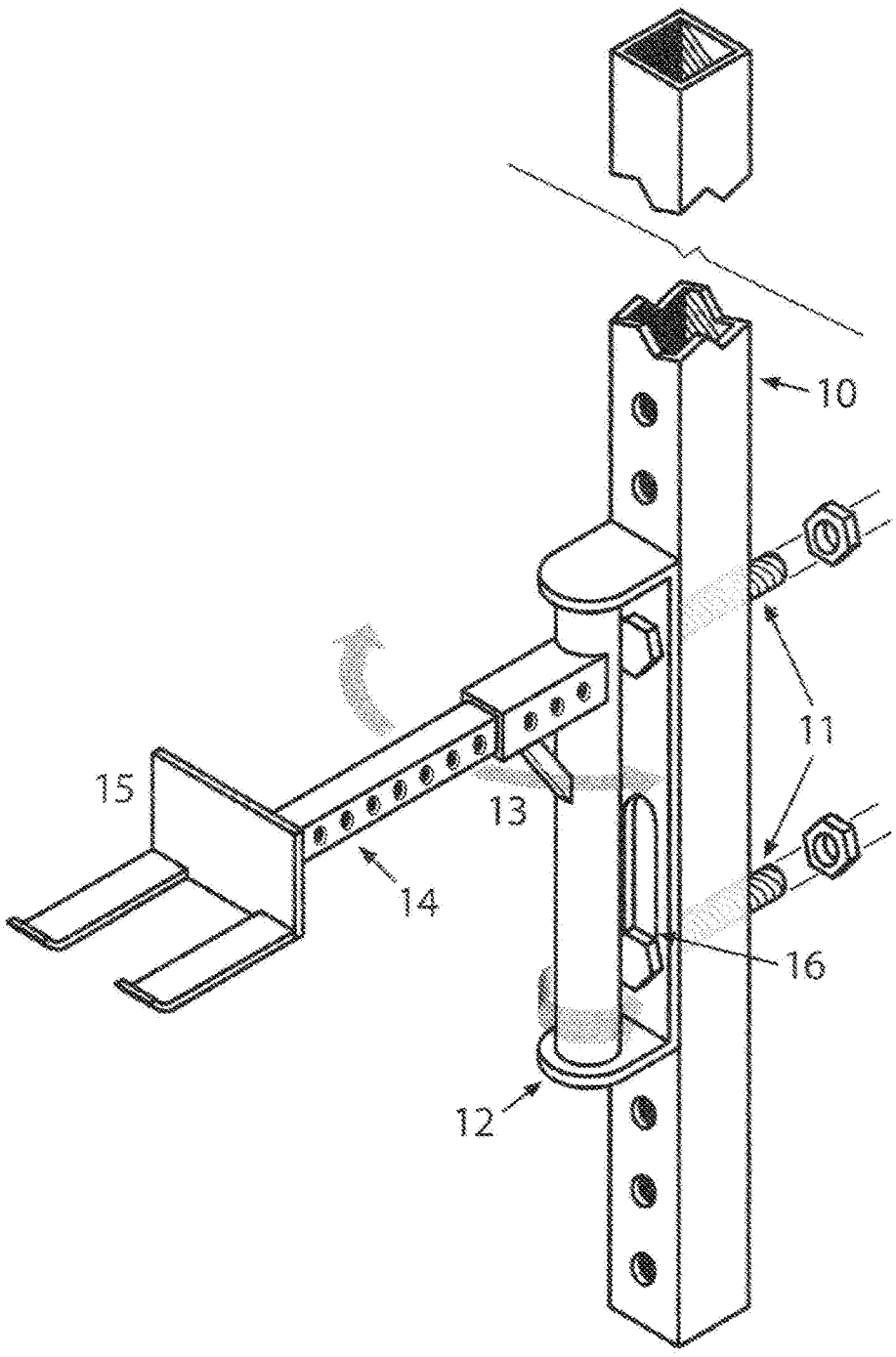
FIG. 2 shows an embodiment of a subset of the invention configured as an attachment to another vertical support such as those found on a piece of exercise equipment commonly called a power rack.

FIG. 2 shows a subset of the invention configured as a temporary addition to another vertical feature such as the vertical supports (10) on a common piece of exercise equipment known as a "power rack". This vertical support is not part of the current invention but is a common occurrence to which the invention form shown in FIG. 2 could attach. In this configuration the horizontal swivel ability (13) for the dumbbell holder arm (14) is obtained via swivel joints (12) in the support brackets rather than via swivel around the vertical support (1) shown in FIG. 1. This is because the vertical supports for a power rack are typically not round, so the horizontal swivel for the invention is provided via swivel joints or other rotational support which are included in this embodiment of the invention. In this embodiment, the invention would be a separate add-on to a power rack (or similar device such as the vertical supports on a bench press rack) which could be quickly added and removed depending on whether the power rack was being used for dumbbell exercises or other exercises unrelated to the present invention. As with the stand-alone version in FIG. 1, one of the invention embodiments shown in FIG. 2 would be placed on either side of the user to support the use of a dumbbell in each hand for the exercise. The vertical adjustment would be accomplished by moving the device up or down on the external support (10) via the attachment pins (11) or other attachment mechanisms such as clamps. A feature such as the oval lower pin hole (16) shown in FIG. 2 could be used to make the attachment fit vertical supports with varying pin-hole spacing. The other features would remain the same as shown in FIG. 1, specifically the dumbbell holder (15) and support arm(s) (14, 2).

Figure 3:
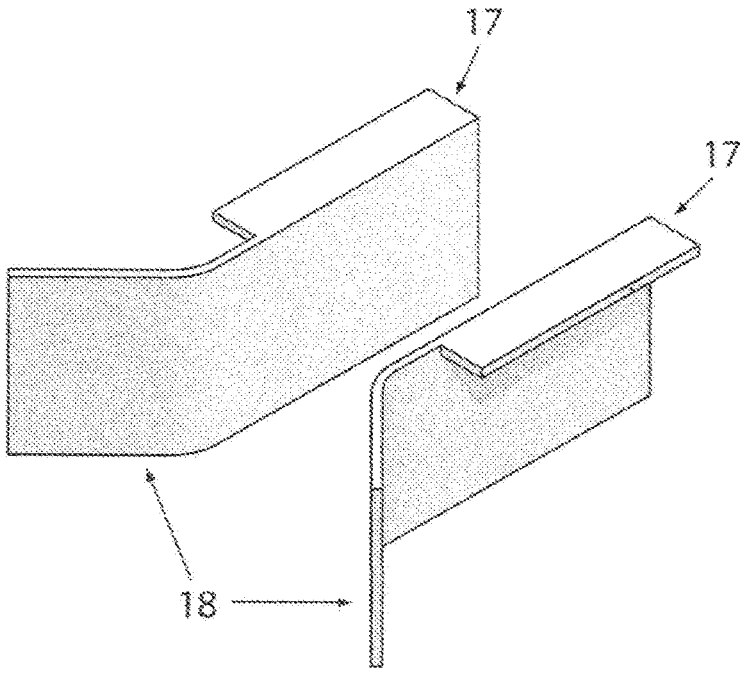
FIG. 3 shows the hand guide channel which would be affixed to the bottom of the dumbbell holder to guide a user's hands when returning the dumbbell to the holder and minimize risk of injury due to unintentional contact between the user's hand, wrist, or arms with the front of the dumbbell holder.

FIG. 3 shows a close-up of an optional hand guide that could be used to provide extra precision in guiding the user's hand into position to return the dumbbell to the rack, thus reducing the risk of injury. The hand guide would attach to the dumbbell holder by affixing the hand guide attachment surface (17) to the underside of the dumbbell holder horizontal supports (16). The angled front portions of the guide (18) would guide the user's hands to the center of the dumbbell holder when returning the dumbbell to the holder. An essential element of any dumbbell holder is minimizing the risk of injury to the user when returning a heavy weight to the holder in a highly fatigued state and the combination of the channeling device (optionally coated with protective padding) with the dumbbell holder minimizes risk of injury.

Figure 4:
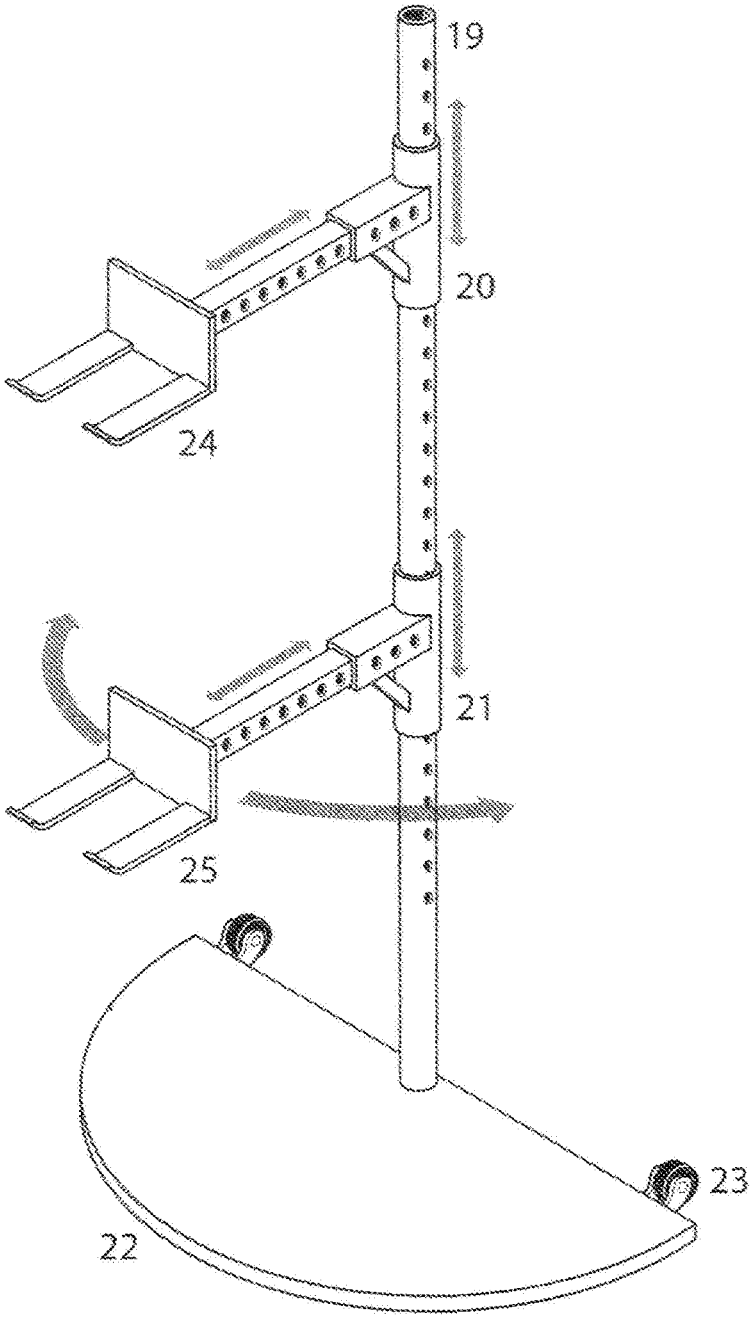
FIG. 4 shows the invention configured as a standalone unit, one of which would typically be positioned on either side of a seated or standing exercise position or apparatus for use with two-handed exercises, or singularly for one-handed exercises.

FIG. 4 shows the invention configured as a free-standing, standalone unit, in this embodiment shown with a single support member (19) although multiple support members could be used. One of these units would be placed on either side of the user who would typically be in either a standing, seated, lying, or incline position to perform the exercise. For example, the user could be seated or lying when the dumbbells are removed from the rack or the user could remove them in a standing position, or sit in the type of seat made for seated dumbbell presses to perform the exercise, and then return to a standing position to return the dumbbells to the rack. Either of these would be a significant advance and far easier than lifting the dumbbells from the floor or using a fixed stand which does not allow for adjustment of the dumbbell position such as described by the prior art.

The lower of the two dumbbell holder/arms (21, 25) would allow the user to return the dumbbell to a lower position if they were unable or did not desire to return the dumbbell to the upper position on the rack (20, 24). Optional wheels/rollers/casters (23) on the base of the unit (22) allow the unit to be easily rolled from one position to another.

In this example of the base (22) configuration, 180 degrees of swivel adjustment is allowed for, however the invention could support 360 degrees of swivel support by use of any base configuration that provided support stability through 360 degrees of travel, or any other range desired in manufacture.

Figure 5:
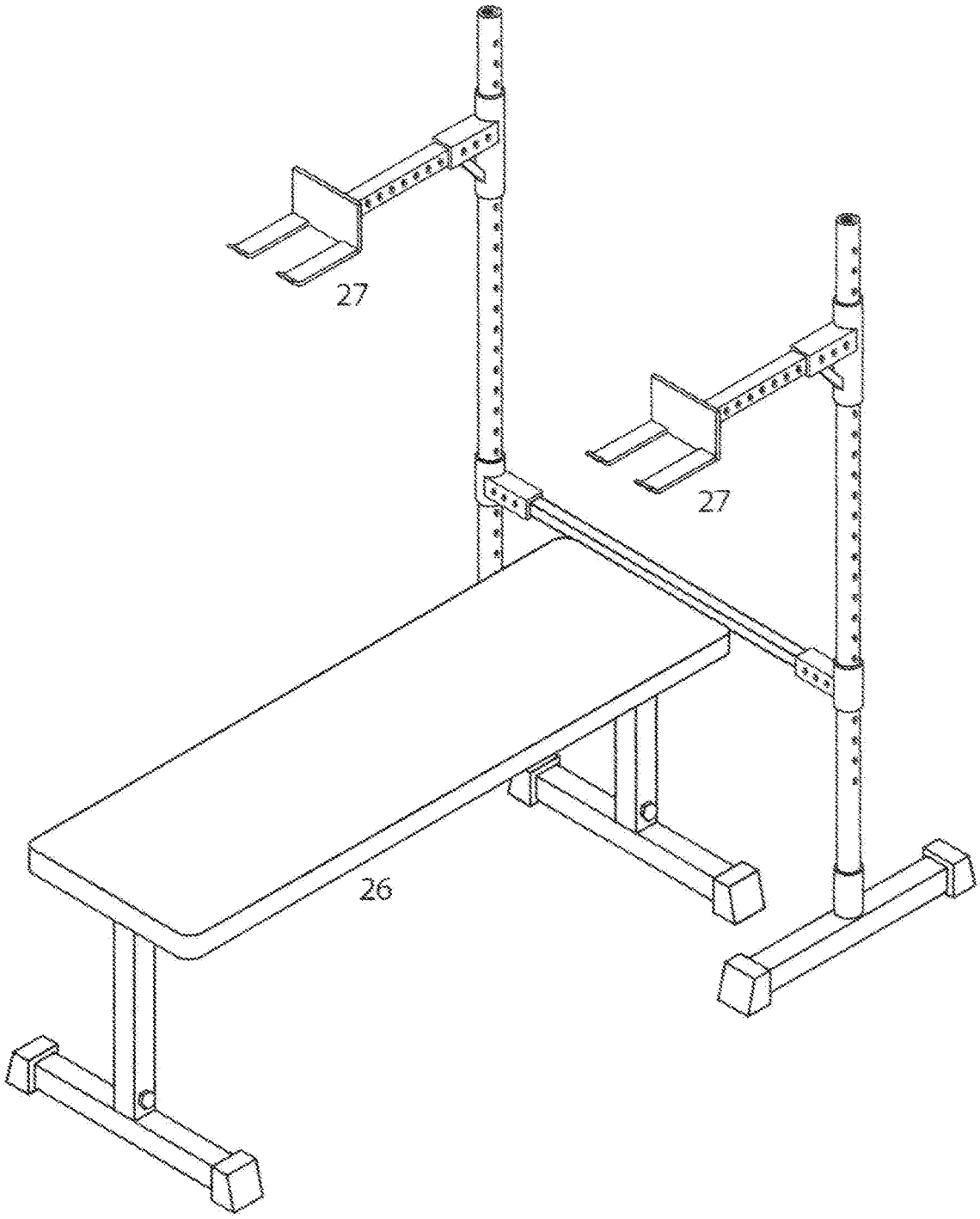
FIG. 5 shows the invention integrated into another piece of exercise equipment, in this embodiment it is integrated into a lying/incline/seated press apparatus.

FIG. 5 shows the invention configured as a permanent integration into a piece of exercise equipment. In the embodiment shown the invention is integrated with a bench press apparatus (26) for performing lying, inclined or seated dumbbell press exercises using the present invention to position the dumbbells for the starting and finishing position (27) in a way similar to how a barbell would be positioned for barbell press exercises. All the features found in the standalone units in FIG. 1 or 4 would apply for the integrated unit with the exception that the integrated unit would be temporarily or permanently attached to another piece of equipment, in this embodiment a unit to support press movements.

In this embodiment, the invention is implemented by attaching the vertical supports (22) similar to those shown in FIG. 1 to a portion of the equipment such that some or all of the stability for the vertical supports is provided by the equipment.

Optionally, any of these embodiments may include the ability to retract the support via the horizontal and/or vertical planes via mechanisms such as a font-controlled lever or a spring mechanism, after the dumbbell is removed from the support to begin the exercise.

Figure 6:
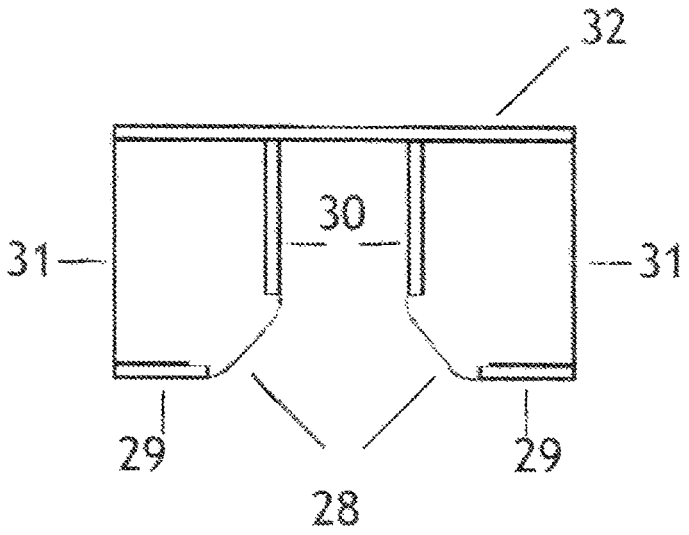
FIG. 6 Shows an overhead view of the dumbbell support portion of the present invention highlighting by way of non-limiting example surfaces, shapes and angles, a channel structure which guides a user's hand and arm to return a dumbbell to the device.
Figure 7:
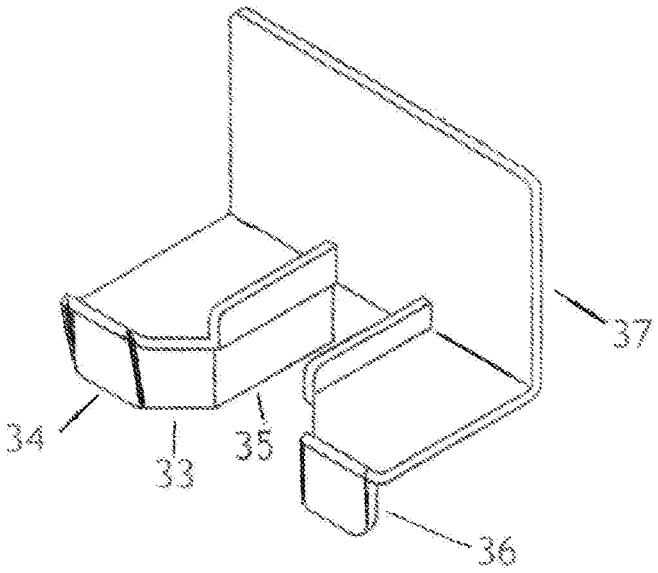
FIG. 7 Shows an oblique view of the dumbbell support portion of the present invention highlighting by use of non-limiting examples of surfaces, shapes and angles, the generally vertical surfaces extending downward from the front lip and inward converging channel structure from the front "lip' and channel boundary that a user's hand or arm could contact upon return of a dumbbell to the device of the present invention.

As introduced in the summary above, the present Invention includes a set of features for a device to support dumbbells for the beginning of an exercise set and to receive the dumbbells for continued support at the conclusion of a set. It is intended to be incorporated into any other apparatus, the combined function of the present invention and the other apparatus being to position dumbbells for the start and conclusion of an exercise set. The unique capabilities and characteristics of the present invention include creation of a combination of a self-centering channel formed by surfaces which create a gradual transition from a front edge/lip/surface of the present device to an inner channel for a user's hand/arm to enter or withdraw from, in combination with contact surfaces designed to reduce potential for concentrated contact between any part of a user's body and the present device, and contact surfaces to support a dumbbell in a position established prior to the start of a set. This combination is required to create an acceptable level of safety when a user of such a device is returning dumbbells at a conclusion of an exercise set, often in a state of extreme fatigue such that a dumbbell may not be well-controlled upon conclusion of a set. FIGS. 6 and 7 disclose additional aspects of the present invention in the form of non-limiting examples, which depict the concept of a converging channel with contact surfaces designed to reduce concentrated contact for a user's hand or arm as previously disclosed above in FIG. 3. The embodiments depicted in FIGS. 6 and 7, and specifically the angles, relative surface sizes, and other features are non-limiting examples of angles, positioning and surfaces to implement the concept of a converging channel for the purpose of a dumbbell holder and do not limit the scope of the invention beyond the general principles stated in the claims.

Referring to FIG. 6, 28 indicates an example boundary line which forms a gradually transitioning surface forming an entry-way into a channel which creates a "self-centering" function to guide a user's hand/arm when returning a dumbbell to the device. While this embodiment shows a generally straight surface with two curved transition points between the front surface in closest proximity to a user of the device 29, 34 and inner channel 30, 35 surfaces, the described self-centering function is not limited to any specific set of angles and/or curves, and, for example, could also be implemented with a completely curved surface forming a surface between said front 29, 34 and inner channel 30, 35 boundaries. 29 indicates a surface in close proximity to a user of the device at the end of a surface which will support a dumbbell 31. Boundary points 30 indicate the demarcation of the rear portion of the center channel and the inside boundaries of the surfaces which will support a dumbbell. 31 indicates an example embodiment of a surface which could support a dumbbell. While this embodiment displays a generally flat, horizontal surface, the scope of the present invention is not limited to such a surface and the distinguishing channel structure of the present invention could be incorporated into any size, shape, orientation and curvature which would support a dumbbell, such a curved support surface. 32 indicates a surface at the rear of the supporting surface 31 which will prevent a dumbbell from exiting the rear of support surfaces. Surface 32 is also not limited to the characteristics shown in this embodiment and could also be any size, shape, orientation and curvature which impedes rearward (away from a user) motion of a dumbbell.

The device of FIGS. 6 and 7, may attach to other devices to create an entire support structure, such as by attachment via connection to, for example rear surface 32 or one or more of the dumbbell support surfaces 31.

Comparing the views of FIGS. 6 and 7 to devices with a similar use intent in the prior art, the prior art shows no surfaces and angles similar to those indicated by 28 or which provide a surface which joins boundaries indicated by 29 and 30. The equivalent angles in prior art are typically approximately 90 degrees and there is typically one angle between the equivalent of the boundaries indicated by 29 and 30 rather than an additional set of gradually converging surfaces with a distributed contact area such as is provided by the present invention.

Referring to FIG. 7, this Figure provides an oblique view and shows the generally vertical surfaces which provide a distributed contact area and which are not clearly visible in the overhead view of FIG. 6. 33 depicts a surface related to the boundary indicated by 28 in FIG. 6. It provides a generally vertical surface against which a user's hand/arm could contact as part of returning a dumbbell to the holder. 34 and 36 indicate a generally vertical surface at the front of a generally horizontal more moderately angled surface 31 configured to support a dumbbell at rest, and 35 indicates a generally vertical surface in the center of the rear portion of the channel feature of the present invention, portions of the channel bounded by generally parallel boundary surfaces.

The combination of these surfaces 33, 34, 35 create a self-centering guide channel beginning at a point of closest proximity to a user where a user's hand/arm could contact. Generally vertical surfaces of sufficient size 33,34,35, specifically any vertical extent greater than one inch of vertical extent, are included to reduce the danger of a user's hand/arm contacting a point where there would be concentrated force and heightened risk of injury such as what could occur with designs shown in prior art.

Having described the invention, I claim:

1. A dumbbell position device for holding a dumbbell in preparation for use in an exercise and to facilitate return of the dumbbell to the device comprising:

two surfaces in spaced relation configured to hold a dumbbell thereon;

a back wall connecting the two surfaces;

each of the surfaces comprising:

a front edge located opposite said back wall, an inner edge, and an interface edge extending from said front edge to said inner edge at obtuse angles thereto;

a first vertical channel wall extending a first distance above said surface along the front edge thereof;

a second vertical channel wall extending a second distance above said surface along the inner edge thereof; and a third vertical channel wall extending a third distance below said surface along the front, inner, and interface edges thereof;

wherein the third distance is greater than said first or second distances;

wherein the first, second, and third channel walls on each surface define a converging channel between the two surfaces and back wall that would guide a user's hand or arm into the channel when returning a dumbbell to the device.

* * * * *